US009649250B2

(12) United States Patent
Tai

(10) Patent No.: US 9,649,250 B2
(45) Date of Patent: May 16, 2017

(54) PERSONAL MASSAGER

(71) Applicant: GS Design HK, Limited, Admiralty (HK)

(72) Inventor: Kenny Chih-Yao Tai, Admiralty (HK)

(73) Assignee: GS DESIGN HK, LIMITED, Admiralty (HK)

( * ) Notice: Subject to any disclaimer, the term of this patent is extended or adjusted under 35 U.S.C. 154(b) by 666 days.

(21) Appl. No.: 13/737,743

(22) Filed: Jan. 9, 2013

(65) Prior Publication Data

US 2014/0194791 A1 Jul. 10, 2014

(51) Int. Cl.

| | |
|---|---|
| ***A61H 19/00*** | (2006.01) |
| ***A61H 23/00*** | (2006.01) |
| ***A61H 23/02*** | (2006.01) |

(52) U.S. Cl.

CPC ..... *A61H 23/02* (2013.01); *A61H 19/30* (2013.01); *A61H 23/0263* (2013.01); *A61H 2201/0111* (2013.01); *A61H 2201/1635* (2013.01); *A61H 2201/5015* (2013.01); *A61H 2201/5035* (2013.01)

(58) Field of Classification Search

CPC ..... A61H 2201/0111; A61H 2201/165; A61H 2201/1604; A61H 2201/1635; A61H 2201/5015; A61H 2201/5035; A61H 19/003; A61H 19/32; A61H 19/34; A61H 19/50

USPC ..... 600/38, 41; 601/46

See application file for complete search history.

(56) References Cited

U.S. PATENT DOCUMENTS

| | | | | |
|---|---|---|---|---|
| 2,286,089 | A * | 6/1942 | Harris | A61H 23/02 601/72 |
| 2,287,501 | A | 9/1942 | Thomas | |
| 2,350,817 | A * | 6/1944 | Purves | A61H 23/0263 310/47 |
| 2,686,325 | A | 3/1950 | Silver | |
| 2,584,649 | A * | 2/1952 | Woodbury | A61H 7/003 601/136 |
| 2,918,055 | A | 12/1959 | Boerger | |
| 3,461,859 | A | 8/1969 | Fortnam | |
| 3,623,481 | A | 11/1971 | Curran | |
| 4,116,233 | A | 9/1978 | Scaduto | |
| 4,270,433 | A * | 6/1981 | Adamec | B01F 17/0064 84/322 |
| 4,308,860 | A * | 1/1982 | Sanders | A46B 1/00 15/227 |
| 5,519,292 | A | 5/1996 | Taylor et al. | |

(Continued)

FOREIGN PATENT DOCUMENTS

FR 59368 1/1954

*Primary Examiner* — Justine Yu
*Assistant Examiner* — Christopher Miller
(74) *Attorney, Agent, or Firm* — Davis Wright Tremaine LLP; Heather M. Colburn

(57) ABSTRACT

A personal massager configured to be worn on a user's finger. The massager includes a housing, and a motor operable to vibrate the housing. The housing defines an opening configured to receive the finger. The housing extends partway around the circumference of the user's finger when the user's finger is received inside the opening. Optionally, the massager includes a control circuit configured to determine a pattern of vibration supplied to the housing by the motor. Optionally, the massager includes a rechargeable battery that provides power to the motor.

18 Claims, 14 Drawing Sheets

(56) References Cited

U.S. PATENT DOCUMENTS 5,601,529 A 2/1997 Wollman
6,203,509 B1 * 3/2001 Duboff ..... A61H 23/0263 601/138
D514,226 S * 1/2006 Nan ..... D24/215
6,991,600 B1 * 1/2006 Wang ..... A61F 5/41 600/38
D523,151 S 6/2006 Telford
D523,152 S 6/2006 Telford
D523,963 S 6/2006 Telford
8,998,795 B2 * 4/2015 Zamar ..... A61F 5/41 600/38
2003/0083598 A1 * 5/2003 Kobayashi ..... A61F 5/41 601/70
2003/0088930 A1 * 5/2003 Abada ..... A46B 5/04 15/110
2003/0181784 A1 * 9/2003 Klein ..... A61F 5/41 600/38
2003/0181835 A1 * 9/2003 Klein ..... 601/72
2004/0020241 A1 * 2/2004 Boiadjian ..... A44C 9/0053 63/15
2004/0230093 A1 * 11/2004 Marshall ..... A61H 19/34 600/38
2005/0155609 A1 * 7/2005 Lin ..... A61F 5/41 128/844
2005/0193565 A1 * 9/2005 Knowles ..... B26B 27/007 30/155
2005/0263596 A1 * 12/2005 Nelson et al. ..... 235/441
2006/0030749 A1 * 2/2006 Hung ..... A61H 23/02 600/38
2006/0247493 A1 * 11/2006 Chen ..... A61F 5/41 600/38
2007/0038019 A1 * 2/2007 Weng ..... A61F 5/41 600/38
2007/0051373 A1 * 3/2007 Lin ..... A61F 5/41 128/844
2008/0009775 A1 * 1/2008 Murison ..... 601/46
2008/0027361 A1 * 1/2008 Lin ..... A61H 19/50 601/46
2008/0077058 A1 * 3/2008 Klearman ..... A61H 19/00 601/70
2009/0012355 A1 * 1/2009 Lin ..... A61H 19/34 600/41
2009/0306468 A1 * 12/2009 Tasker ..... A61H 19/34 600/41
2009/0312599 A1 * 12/2009 Smith ..... A61H 19/34 600/38
2009/0318755 A1 * 12/2009 Adams ..... A61F 5/41 600/41
2010/0010292 A1 * 1/2010 Talbot ..... A61H 19/34 600/38
2011/0166415 A1 * 7/2011 Zamar ..... A61F 5/41 600/38
2012/0116273 A1 * 5/2012 Nan ..... A61H 19/34 601/46
2012/0179077 A1 * 7/2012 Tuck et al. ..... 601/46
2012/0184884 A1 * 7/2012 Dyer ..... A61H 19/50 601/46
2012/0259254 A1 * 10/2012 Chen ..... A61H 23/0263 601/46
2012/0295451 A1 * 11/2012 Hyun-Jun et al. ..... 439/39
2013/0041211 A1 * 2/2013 Zamar ..... A61H 19/00 600/38
2013/0077277 A1 * 3/2013 Da Silva ..... A61B 17/54 361/807
2013/0158446 A1 * 6/2013 Nan ..... A61H 19/34 601/46

* cited by examiner

PERSONAL MASSAGER

BACKGROUND OF THE INVENTION

Field of the Invention

The present invention is directed generally to vibrating massagers, and, more particularly, to vibrating massagers configured to be worn on a user's finger.

Description of the Related Art

Vibrating massagers and sex toys are used by many people. Because different people's preferences vary, there is a need for new devices. Waterproof massagers that may be used in a shower or submerged in water are particularly desirable. The present application provides these and other advantages as will be apparent from the following detailed description and accompanying figures.

BRIEF DESCRIPTION OF THE SEVERAL VIEWS OF THE DRAWING(S)

DETAILED DESCRIPTION OF THE INVENTION

Figure 1:
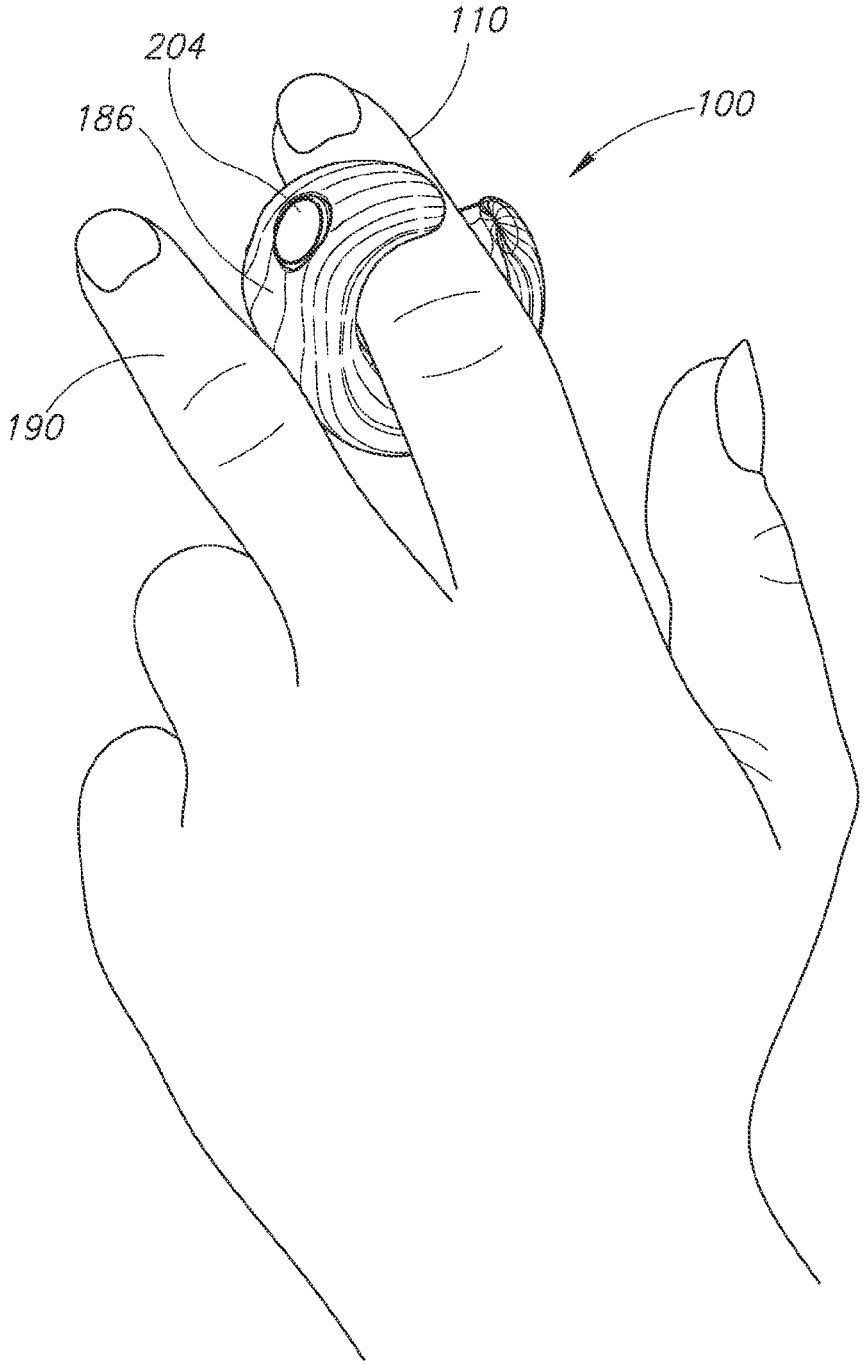
FIG. 1 is a perspective view of a personal massager positioned on a finger of a user.

FIG. 1 depicts a personal massager 100 configured to be worn on a finger 110 of a user. The massager 100 may be characterized as being form fitted to the finger of the user.

Further, the massager 100 may be configured to be worn on a finger of either the right hand or the left hand of the user. Thus, the massager 100 may be characterized as being ambidextrous.

The massager 100 is configured to be positioned (e.g., pressed) against a portion of a surface of a body of the user or another person. The massager 100 is configured to vibrate in a manner that massages the portion of the surface against which the massager is positioned. The massager 100 may be used to achieve sexual arousal and/or orgasm.

Figure 2:
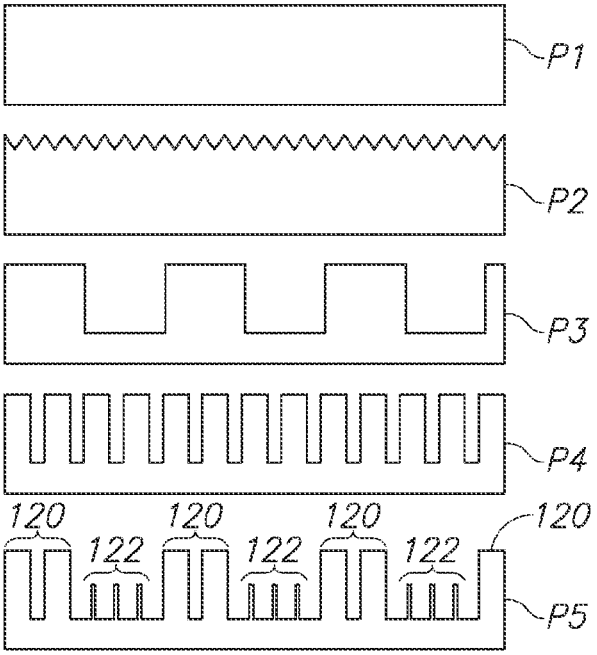
FIG. 2 is an illustration of five vibration patterns (or waveforms).

The massager 100 may be configured to deliver a plurality of vibration patterns (e.g., vibration patterns P1-P5 illustrated in FIG. 2). FIG. 2 provides visual representations (e.g., waveforms) representing each of the five non-limiting examples of vibration patters P1-P5 that may be delivered by the massager 100. The first pattern P1 indicates the massager 100 is providing a maximum amount of vibration. The patterns P2-P5 indicates the massager 100 is providing less than the maximum amount of vibration. The patterns P2-P4 indicate the massager 100 is providing a train of vibration pulses. The pattern P5 indicates the massager 100 is providing two different pulse types: pulses 120 of a first type followed by pulses 122 of a second type.

Figure 3:
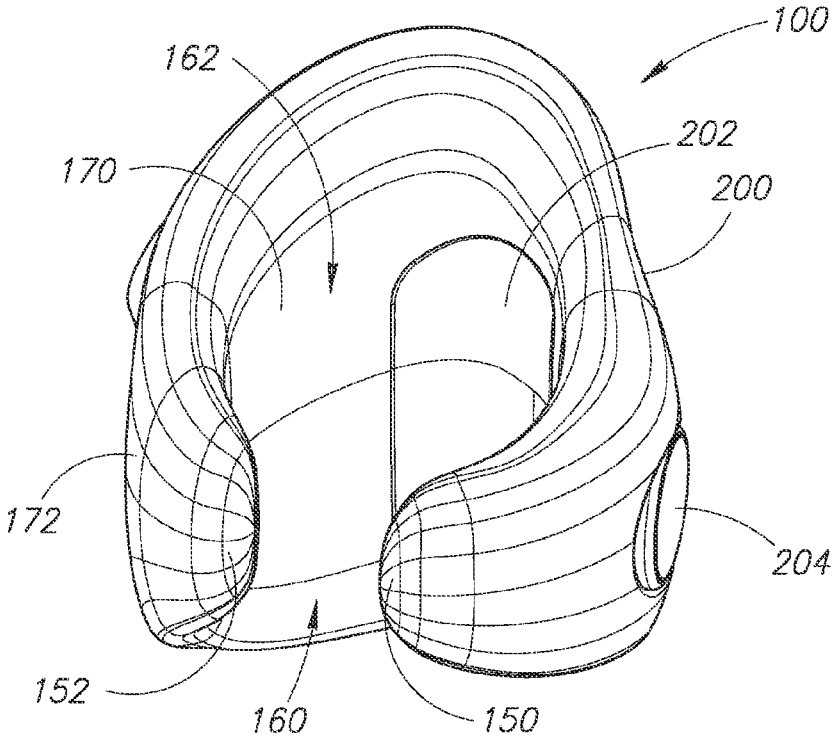
FIG. 3 is a perspective view of the personal massager of FIG. 1.
Figure 4:
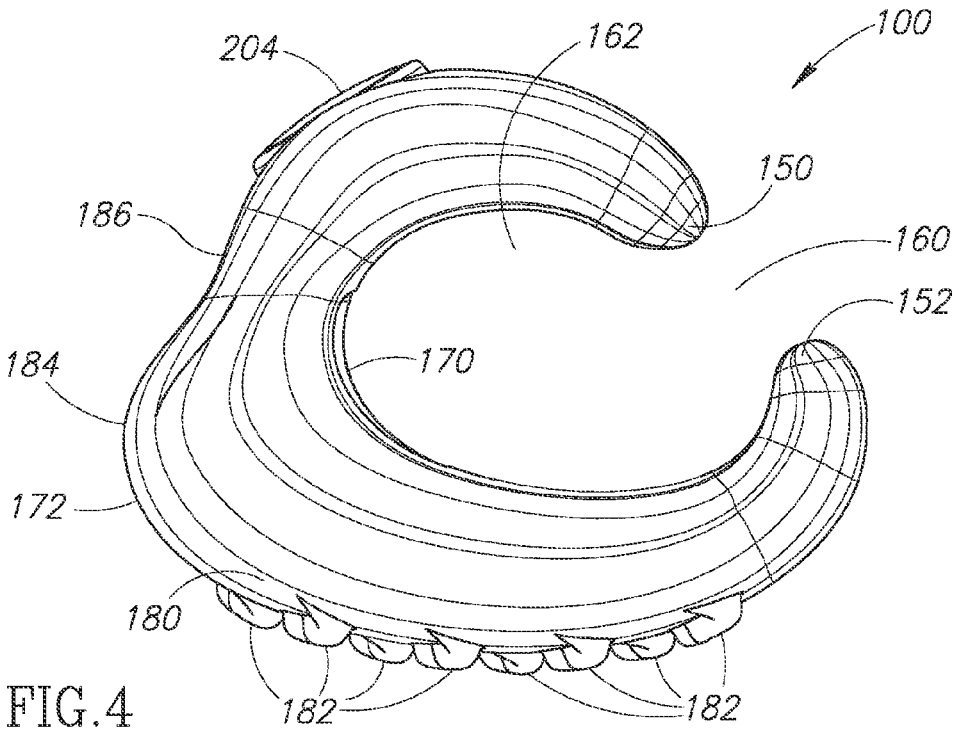
FIG. 4 is a back view of the personal massager of FIG. 1.

Turning to FIGS. 3 and 4, the massager 100 is generally C-shaped having a first end portion 150 spaced apart from a second end portion 152 to define a gap 160 therebetween. Thus, the massager 100 is configured to extend partway around the circumference of the finger 110 (see FIG. 1). The massager 100 has a longitudinally extending opening 162 that receives the finger 110 (see FIG. 1) of the user. The massager 100 is configured to be flexible so that the gap 160 may be widened to enlarge the opening 162 to accommodate larger fingers. Similarly, the first and second end portions 150 and 152 may be pressed toward one another to reduce the size of the opening 162, if desired.

The massager 100 has a first surface 170 that faces toward and is adjacent the finger 110 (see FIG. 1). The massager 100 has a second surface 172 that faces outwardly away from the finger 110.

Figure 5:
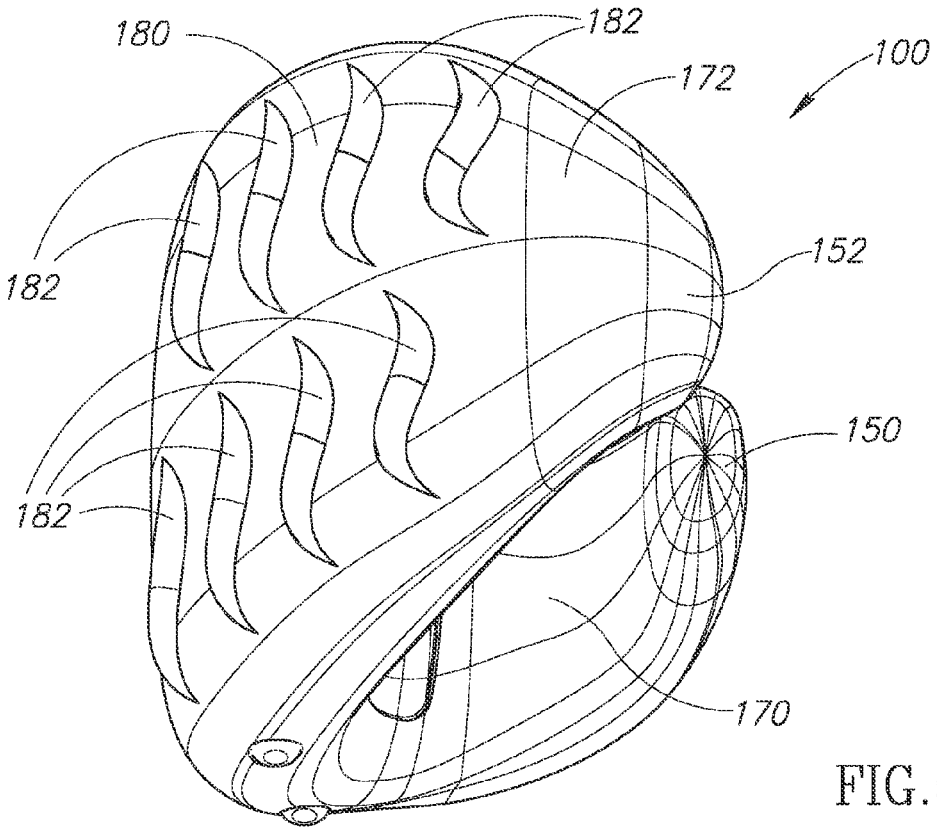
FIG. 5 is a perspective view of the personal massager of FIG. 1.
Figure 6:
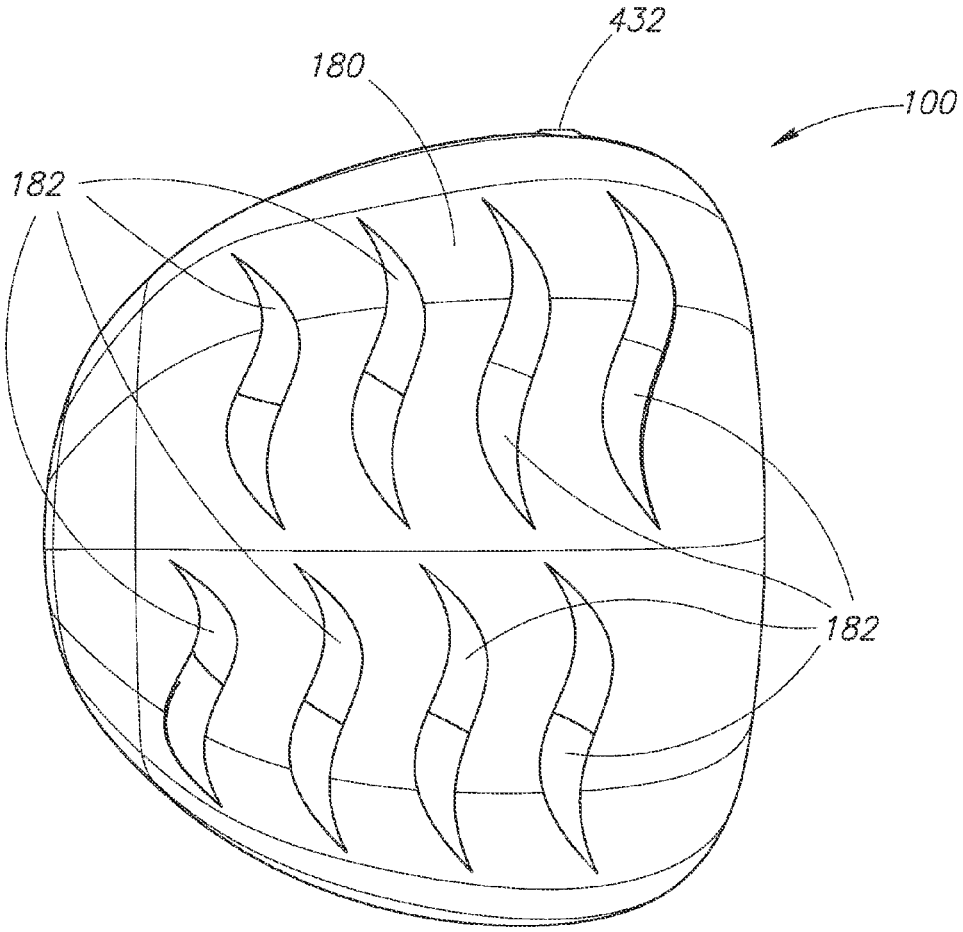
FIG. 6 is a bottom view of the personal massager of FIG. 1.

Turning to FIGS. 4 and 5, in the embodiment illustrated, the second surface 172 has a massaging portion 180 that optionally includes projections 182 (e.g., ridges, bumps, and the like). Referring to FIG. 6, the massaging portion 180 is generally D-shaped. However, this is not a requirement.

Returning to FIG. 4, in the embodiment illustrated, the massager 100 has an outwardly extending portion 184 adjacent the massaging portion 180 and a recessed portion 186 positioned between the first end portion 150 and the outwardly extending portion 184. A neighboring finger 190 (see FIG. 1) adjacent the finger 110 may be positioned in the recessed portion 186. The neighboring finger 190 may press against the outwardly extending portion 184 when the neighboring finger 190 is positioned in the recessed portion 186 to press the massaging portion 180 against a portion of the surface of the body of the user or another person.

In the embodiment illustrated, the massager 100 has a thickness defined between the first and second surfaces 170 and 172. The massager 100 is thicker nearer the outwardly extending portion 184 than at the first and second end portions 150 and 152. Further, referring to FIG. 5, the massager 100 has a longitudinal dimension that extends along the finger 110 (see FIG. 1). The massager 100 is longer at the massaging portion 180 than at the first and second end portions 150 and 152 along the longitudinal dimension. By way of a non-limiting example, the massager 100 may be approximately 3.25 cm to approximately 3.75 cm long at the massaging portion 180. By way of a non-limiting example, laterally, the massager 100 may be approximately 3.25 cm to approximately 3.75 cm wide.

Figure 7:
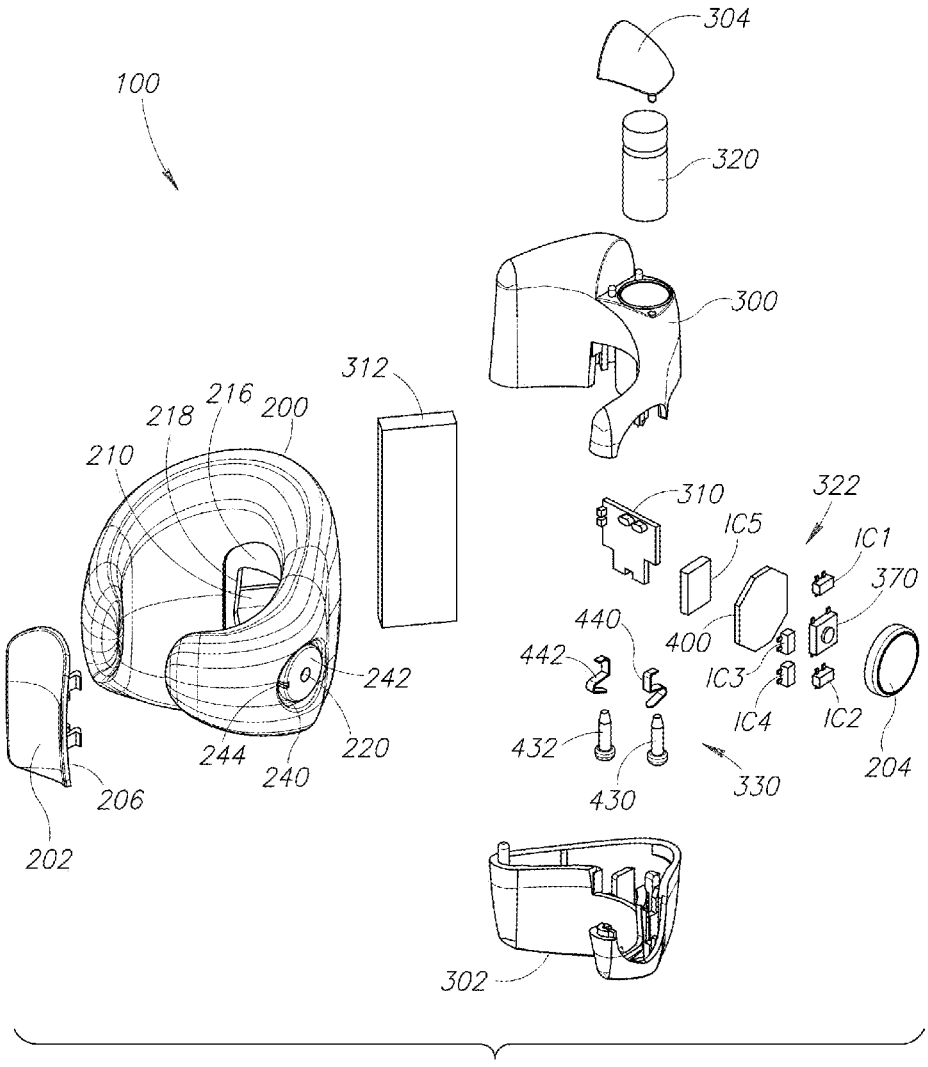
FIG. 7 is an exploded perspective view of the personal massager of FIG. 1.
Figure 8:
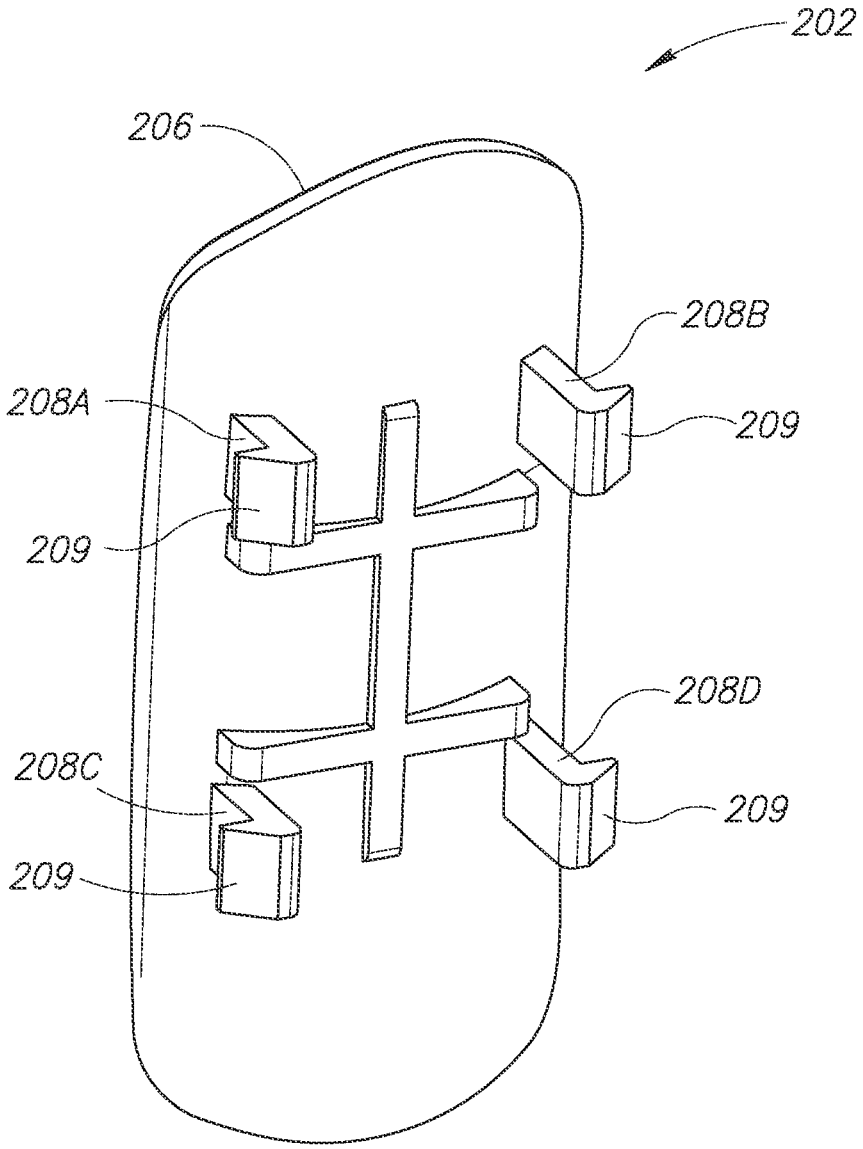
FIG. 8 is a perspective view of a curved cover plate of the personal massager of FIG. 1.

Returning to FIG. 3, the massager 100 includes an outer cover 200, a curved cover plate 202, and a button or actuator 204. Referring to FIGS. 7 and 8, the curved cover plate 202 has a curved portion 206 and one or more inwardly extending connector members 208A-D. Each of the connector members 208A-D has a laterally extending tab 209.

Turning to FIG. 7, together the outer cover 200 and the curved portion 206 of the curved cover plate 202 define an interior enclosure 210. The outer cover 200 is constructed from a compressible and/or flexible material such as silicone. The curved cover plate 202 may also be constructed from a compressible and/or flexible material such as silicone. The outer cover 200 and the curved portion 206 of the curved cover plate 202 are each contoured to provide a smooth outer surface. The enclosure 210 may be waterproof. Thus, the massager 100 may be used in water (e.g., in a shower or bath) and/or washed without damaging components housed inside the enclosure 210.

The outer cover 200 includes a recess 216 and an opening 218. The recess 216 is configured to receive the curved portion 206 of the curved cover plate 202 with the connector members 208A-D (see FIG. 8) extending into the enclosure 210 through the opening 218. When the curved cover plate 202 is so positioned, the outwardly facing surface of the curved portion 206 is flush with the outwardly facing surface of the outer cover 200 so the first surface 170 of the massager 100 in smooth.

Figure 9:
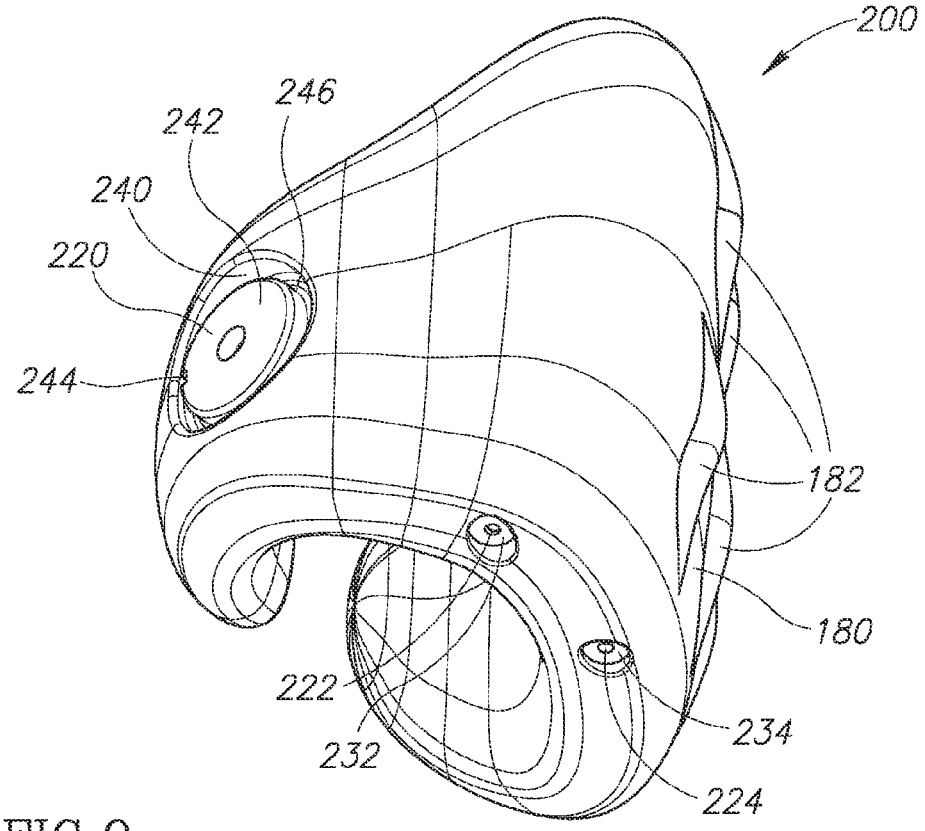
FIG. 9 is a perspective view of an outer cover of the personal massager of FIG. 1.

Turning to FIG. 9, an opening 220 is formed the outer cover 200 and provides a throughway to the enclosure 210 through the outer cover 200. A circular-shaped channel 240 surrounds and is spaced apart from the opening 220. The channel 240 defines a disk-shaped portion 242 having the opening 220 formed therein. In the embodiment illustrated, the opening 220 is formed in the center of the disk-shaped portion 242. A notch 244 is formed on along a peripheral portion 246 of the disk-shaped portion 242. The notch 244 opens up into the channel 240.

In embodiments that are configured to be rechargeable, such as the one illustrated in the figures, openings 222 and 224 are also formed in the outer cover 200 to provide throughways into the enclosure 210 through the outer cover 200. The openings 222 and 224 are positioned within recesses 232 and 234, respectively.

Figure 10:
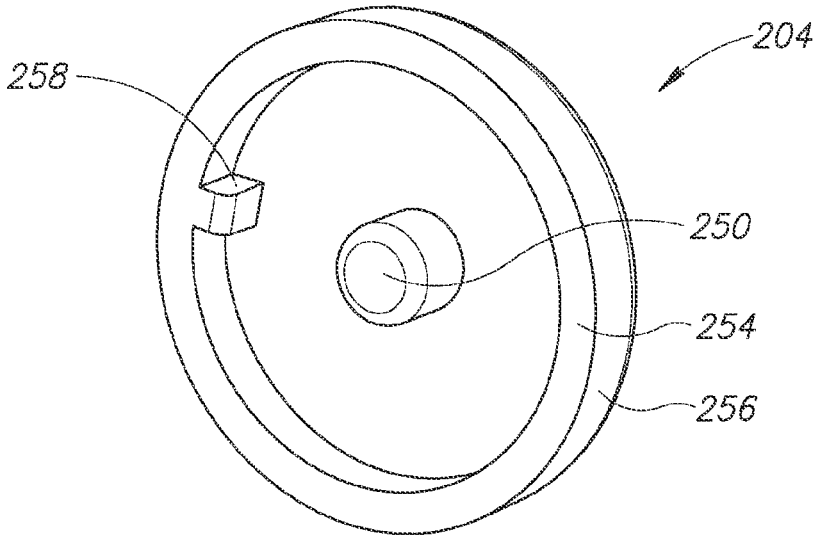
FIG. 10 is a perspective view of an actuator of the personal massager of FIG. 1.

Returning to FIG. 7, the actuator 204 may be constructed from a different material (e.g., stainless steel alloy) and may include one or more trademarks, logos, other insignias, and/or decorative elements. The actuator 204 is positioned along the second surface 172 (see FIG. 3) and is aligned with the opening 220. As may be viewed in FIG. 10, the actuator 204 includes a projection 250 configured to be received inside the opening 220 (see FIG. 9). Friction between the projection 250 and the inside surface of the opening 220 helps maintain the projection 250 inside the opening 220. Optionally, an adhesive (e.g., glue) may be used to adhere the projection 250 to the inside of the opening 220. The actuator 204 includes a circle-shaped lip 254 that extends outwardly (in the same direction as the projection 250) and along a peripheral portion 256 of the actuator 204. In the embodiment illustrated, the projection 250 is positioned centrally with respect to the lip 254. A tab 258 is positioned adjacent the lip 254 and extends inwardly toward the projection 250. The lip 254 is configured to be received inside the channel 240 (see FIG. 9) and the tab 258 is configured to be received inside the notch 244 (see FIG. 9).

Returning to FIG. 7, inside the enclosure 210, the massager 100 includes a first inner housing portion 300, a second inner housing portion 302, an inner housing cover 304, a first substrate 310, a battery 312, a motor 320, and a motor control subassembly 322. In embodiments that are configured to be rechargeable, such as the one illustrated in the figures, the massager 100 includes an optional recharging subassembly 330.

The first inner housing portion 300, the second inner housing portion 302, and the inner housing cover 304 are described below. When assembled together, the first inner housing portion 300, the second inner housing portion 302, and the inner housing cover 304 form an inner housing 332 (see FIG. 15) positioned inside the enclosure 210. The inner housing 332 houses the first substrate 310, the battery 312, and the motor 320. In embodiments configured to be rechargeable, such as the one illustrated in the figures, the inner housing 332 may house portions of the optional recharging subassembly 330.

Figure 11:
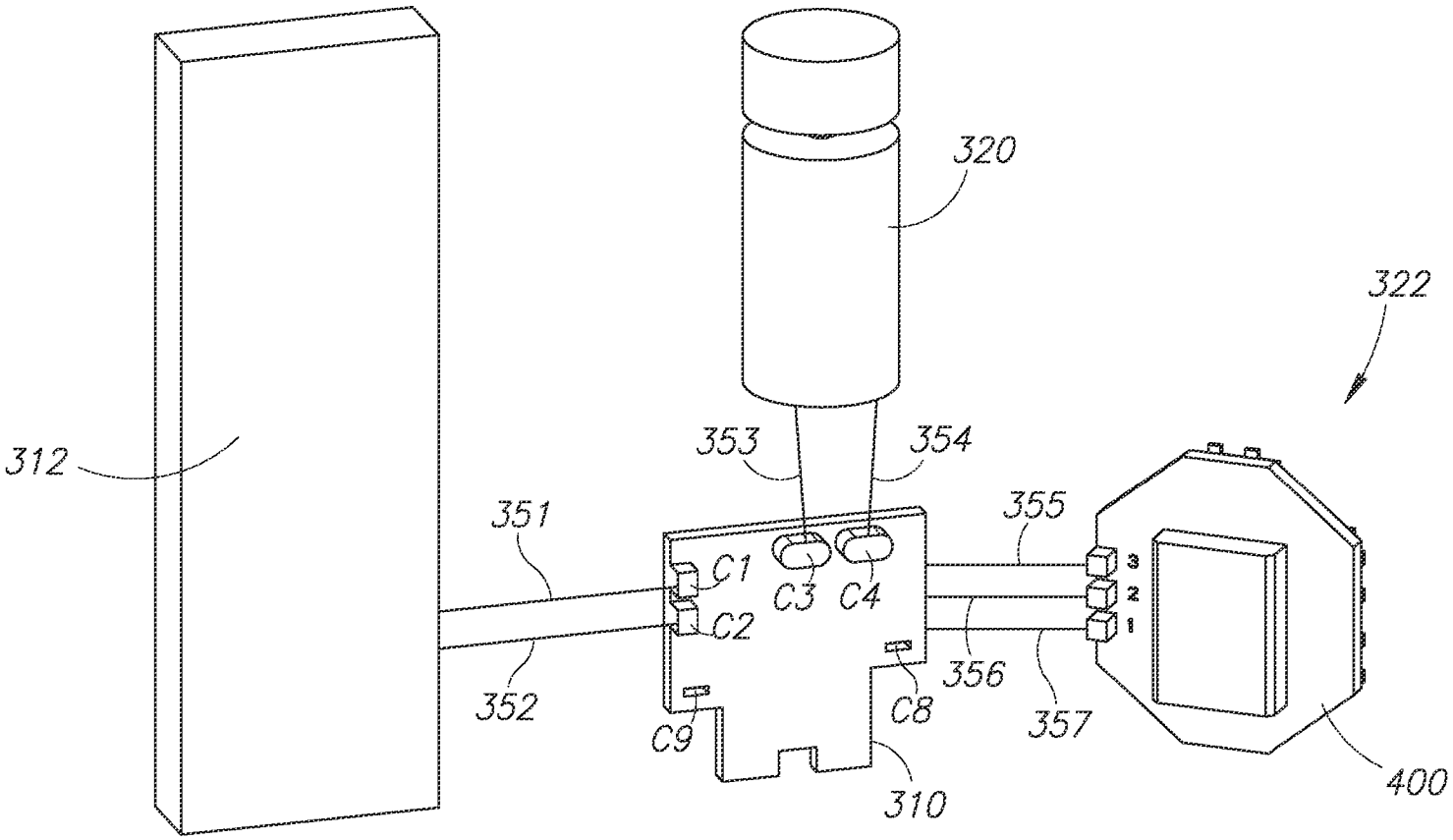
FIG. 11 is a perspective view of a motor, a battery, a first substrate, and a motor control subassembly of the personal massager of FIG. 1.
Figure 12:
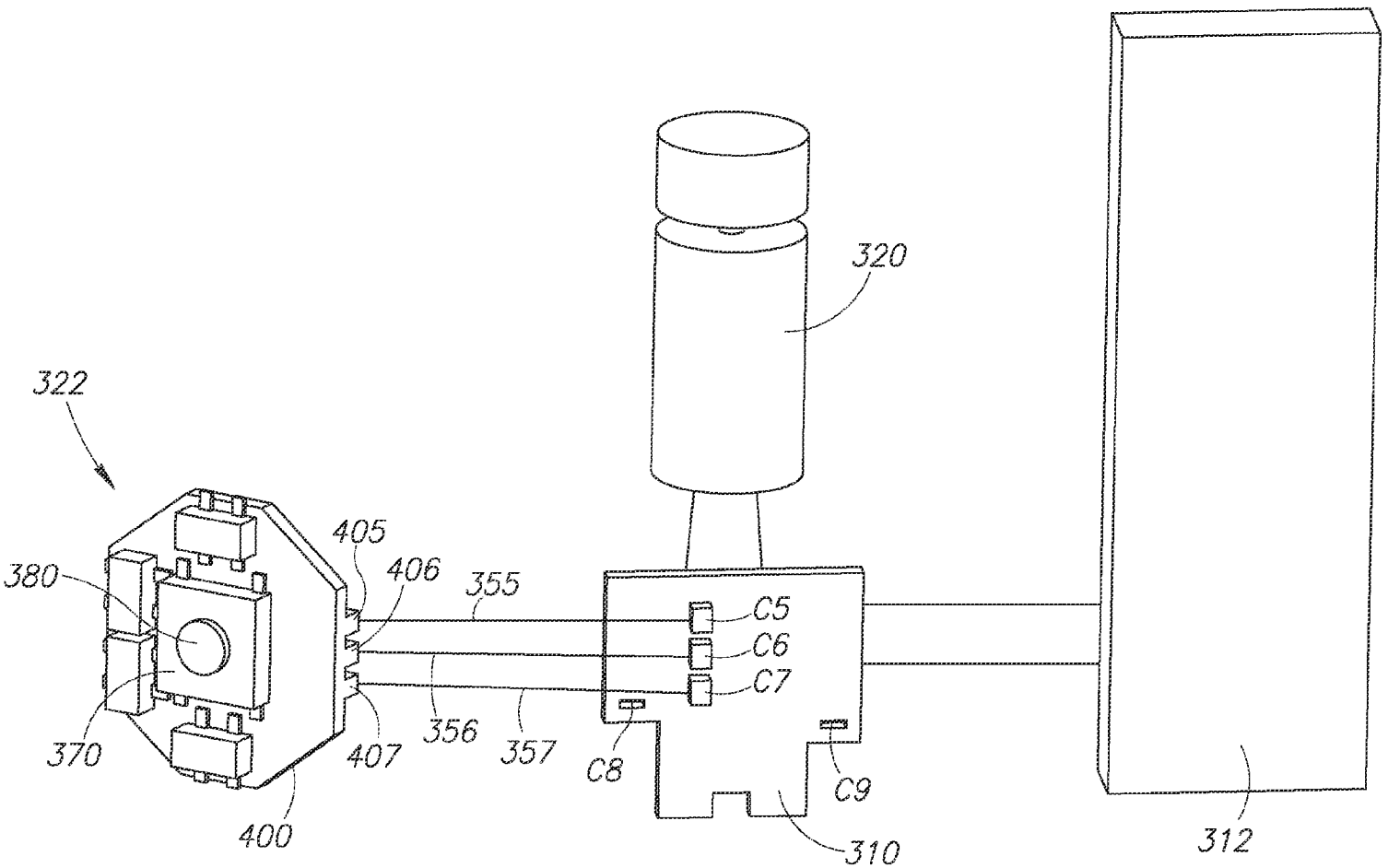
FIG. 12 is a perspective view of the motor, the battery, the first substrate, and the motor control subassembly of the personal massager of FIG. 1.

Turning to FIGS. 11 and 12, the first substrate 310 includes contacts C1-C7. The contacts C1 and C2 are connected to the battery 312, the contacts C3 and C4 are connected to the motor 320, and the contacts C5-C7 are connected to the motor control subassembly 322. The contacts C1 and C2 receive power from the battery 312 that is supplied to the motor 320 via the contacts C3 and C4. The contacts C5-C7 receive signals from the motor control subassembly 322 that control the power received from the battery 312 and supplied to the motor 320. Optionally, the first substrate 310 includes contacts C8 and C9 (e.g., plated through-holes) configured to be connected to the optional recharging subassembly 330 (see FIG. 7).

The battery 312 may be implemented using any battery suitable for powering the motor 320. In the embodiment illustrated, the battery 312 has been implemented as a 3.7 volt, 65 milliampere-hour ("mAh"), rechargeable battery. However, this is not a requirement. The battery 312 is connected to the contacts C1 and C2 of the first substrate 310 by conductors 351 and 352, respectively. The battery 312 may be configured to last about 1.5 hours to about 2 hours when fully charged. Depending upon the implementation details, the optional recharging subassembly 330 (see FIG. 7) may fully charge the battery 312 in about two hours.

The motor 320 is connected to the contacts C3 and C4 of the first substrate 310 by conductors 353 and 354, respectively. The motor 320 may be implemented using any suitable motor operable to produce one or more vibration patterns (e.g., one or more of the plurality of vibration patterns P1-P5 illustrated in FIG. 2). The motor 320 is configured to vibrate the other components of the massager 100 (see FIGS. 1 and 3-7). In the embodiment illustrated, the motor 320 has been implemented using a 3.7 volts, 12,000 revolutions per minute ("RPM") direct current ("DC") motor. However, this is not a requirement. By controlling the flow of current to the motor 320, vibration produced by the motor 320 may be controlled. For example, the motor 320 may produce vibration by rotating an asymmetrical (or off-center) weight (not shown) on the end of a shaft (not shown). By changing the rate at which the weight (not shown) is rotated, the vibration produced by the motor 320 may be changed. Similarly, by providing intermittent power or varying current, the manner in which the weight is rotated may be controlled. Thus, by patterning or otherwise controlling the current provided to the motor 320, vibration produced by the motor 320 may be controlled to produce one or more vibration patterns (e.g., one or more of the plurality of vibration patterns P1-P5 illustrated in FIG. 2).

Figure 13:
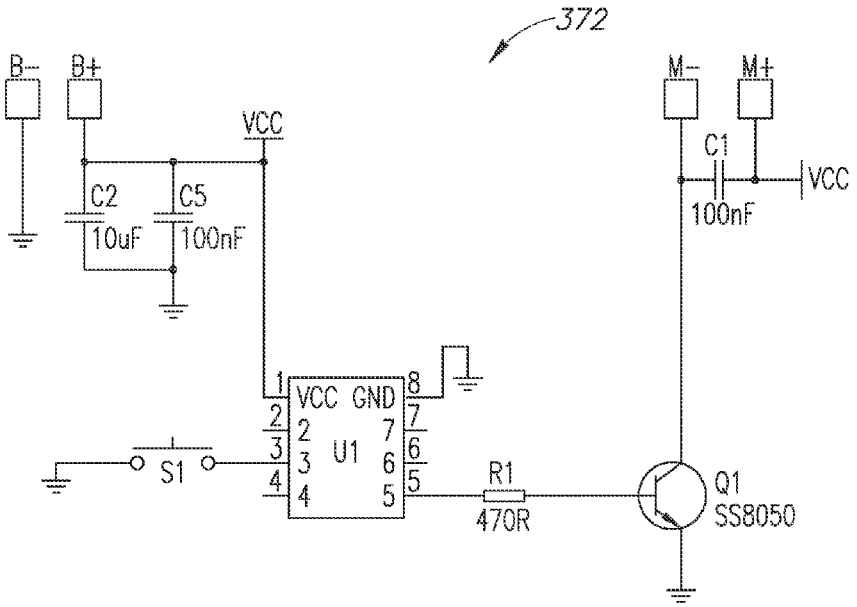
FIG. 13 is a circuit diagram depicting an exemplary implementation of a control circuit of the motor control subassembly.

Turning to FIG. 7, the motor control subassembly 322 includes a switch 370, and a control circuit 372 (see FIG. 13) connected to the switch 370. FIG. 13 is a circuit diagram depicting an exemplary implementation of the control circuit 372. In FIG. 13, the switch 370 is represented by a circuit element "S1." Further, in FIG. 13, the contacts C1 and C2 (see FIG. 11) are represented by circuit elements "B−" and "B+," respectively, and the contacts C3 and C4 (see FIG. 11) are represented by circuit elements "M-" and "M+," respectively. Circuit element "VCC" represents a supply voltage.

Returning to FIG. 7, the switch 370 is positioned inside the enclosure 210 adjacent the opening 220. When the actuator 204 is pressed, the projection 250 (see FIG. 10) presses on an internal actuator 380 (see FIG. 12) of the switch 370 depressing the internal actuator 380. When the internal actuator 380 of the switch 370 is depressed, the switch 370 signals the other circuit elements of the control circuit 372 (see FIG. 13). In the embodiment illustrated, the control circuit 372 may be implemented using integrated circuits IC1-IC5, and a second substrate 400. The integrated circuits IC1-IC5 are positioned on the second substrate 400. Turning to FIG. 12, the second substrate 400 has three contacts 405-407. The contacts 405-407 are connected to the contacts C5-C7 on the first substrate 310 by conductors 355-357.

As explained above, vibration produced by the motor 320 may be controlled by patterning or otherwise controlling the current supplied to the motor 320. The control circuit 372 (see FIG. 13) is configured to cycle through a predefined series of actions. For example, if the motor 320 is off, depressing the internal actuator 380 may turn the motor 320 on and configure the motor 320 to vibrate to produce the first pattern P1 (see FIG. 2). If the motor 320 is producing the first pattern P1 (see FIG. 2), depressing the internal actuator 380 may configure the motor 320 to produce the second pattern P2 (see FIG. 2). If the motor 320 is producing the second pattern P2 (see FIG. 2), depressing the internal actuator 380 may configure the motor 320 to produce the third pattern P3 (see FIG. 2). If the motor 320 is producing the third pattern P3 (see FIG. 2), depressing the internal actuator 380 may configure the motor 320 to produce the fourth pattern P4 (see FIG. 2). If the motor 320 is producing the fourth pattern P4 (see FIG. 2), depressing the internal actuator 380 may configure the motor 320 to produce the fifth pattern P5 (see FIG. 2). Thus, the motor 320 may be configured to produce the vibration patterns P1-P5 in order. If the motor 320 is producing the fifth pattern P5 (see FIG. 2), depressing the internal actuator 380 may turn the motor 320 off, or alternatively, configure the motor 320 to vibrate to produce the first pattern P1 (see FIG. 2). Optionally, no matter which of the patterns P1-P5 the motor 320 is producing, the control circuit 372 may be configured to turn the motor 320 off when the user presses the actuator 204 (thereby depressing the internal actuator 380) for a predetermined amount of time (e.g., three seconds).

Figure 14:
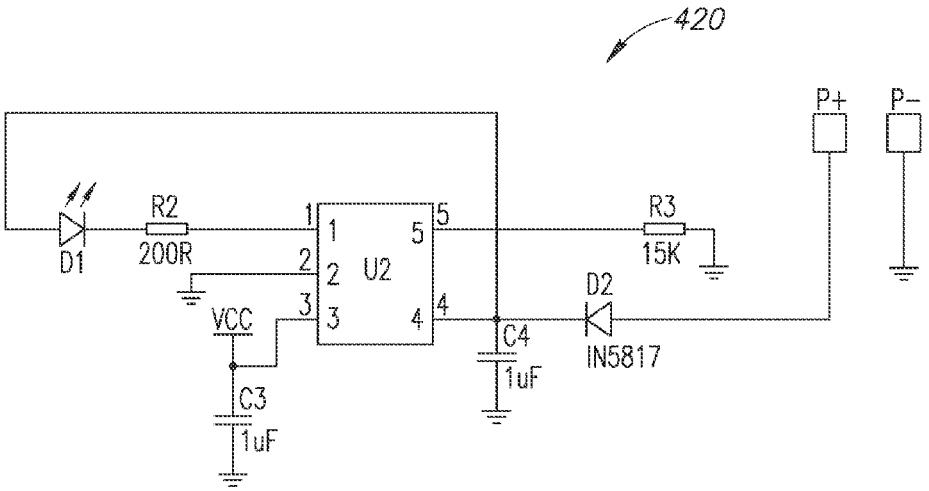
FIG. 14 is a circuit diagram depicting an exemplary implementation of a recharging circuit of a recharging subassembly.

Turning to FIG. 7, the optional recharging subassembly 330 includes a recharging circuit 420 (see FIG. 14), magnetic contacts 430 and 432, and conductors 440 and 442. FIG. 14 is a circuit diagram depicting an exemplary implementation of the recharging circuit 420. In FIG. 14, the contacts C8 and C9 illustrated in FIG. 12 (and connected to the magnetic contacts 430 and 432 (see FIG. 7), respectively) are represented by circuit elements "P−" and "P+," respectively. Further, as is appreciated by those of ordinary skill in the art, the circuit element "VCC" is the same supply voltage identified by the circuit element "VCC" in FIG. 13. In other words, the control circuit 372 and the recharging circuit 420 are both connected to the circuit element "VCC."

Turning to FIG. 7, the magnetic contacts 430 and 432 are connected to the conductors 440 and 442, respectively. The conductors 440 and 442 connect the magnetic contacts 430 and 432 (see FIGS. 11 and 12), respectively, to the first substrate 310. At least a portion of the recharging circuit 420 (see FIG. 14) is positioned on the first substrate 310.

Turning to FIG. 14, the recharging circuit 420 connects the circuit elements "P−" and "P+" (representing the contacts C8 and C9, respectively, illustrated in FIG. 11) to the circuit elements "B−" and "B+" (representing the contacts C1 and C2, respectively, illustrated in FIG. 11) connected to the battery 312 (see FIG. 11) by the conductors 351 and 352 (see FIG. 11), respectively. Thus, power supplied to the contacts C8 and C9 may be transferred via the recharging circuit 420 to the battery 312.

Figure 15:
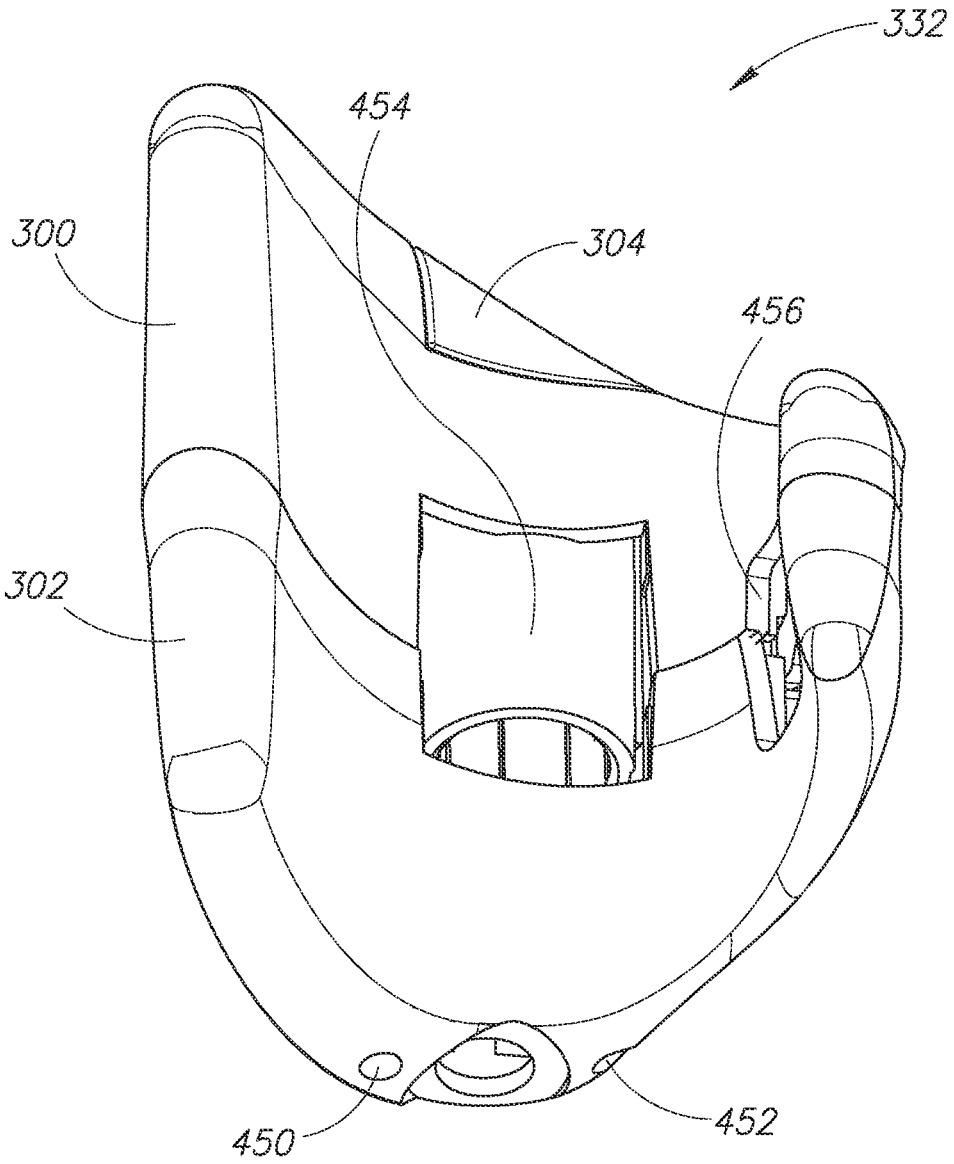
FIG. 15 is a perspective view of an inner housing of the personal massager of FIG. 1.

Referring to FIG. 15, as mentioned above, the first inner housing portion 300, the second inner housing portion 302, and the inner housing cover 304 form the inner housing 332. In the embodiment illustrated, the first inner housing portion 300 and the second inner housing portion 302 are configured to snap together. Similarly, the first inner housing portion 300 and the inner housing cover 304 are configured to snap together. Optionally, an adhesive may be used to adhere these components together.

The inner housing 332 includes openings 450-456. The openings 450 and 452 provide throughways for the magnetic contacts 430 and 432 (see FIG. 7), respectively. The opening 454 is adjacent the opening 218 (see FIG. 7) in the outer cover 200 and configured to receive the connector members 208A-208D (see FIG. 8). The tabs 209 (see FIG. 8) of the connector members 208A-208D extend beyond the edge of the opening 454 to prevent the curved cover plate 202 from being removed from the inner housing 332 after the connector members 208A-208D of the curved cover plate 202 are inserted into the openings 218 and 454. Thus, the curved cover plate 202 may be snap fit to both the inner housing 332 and the outer cover 200.

Turning to FIG. 7, the opening 456 (see FIG. 15) is configured such that the second substrate 400, the switch 370, and the integrated circuits IC1-IC5 may be positioned therein. The conductors 355-357 (see FIGS. 11 and 12) may extend inside the inner housing 332 through the opening 456.

Figure 16:
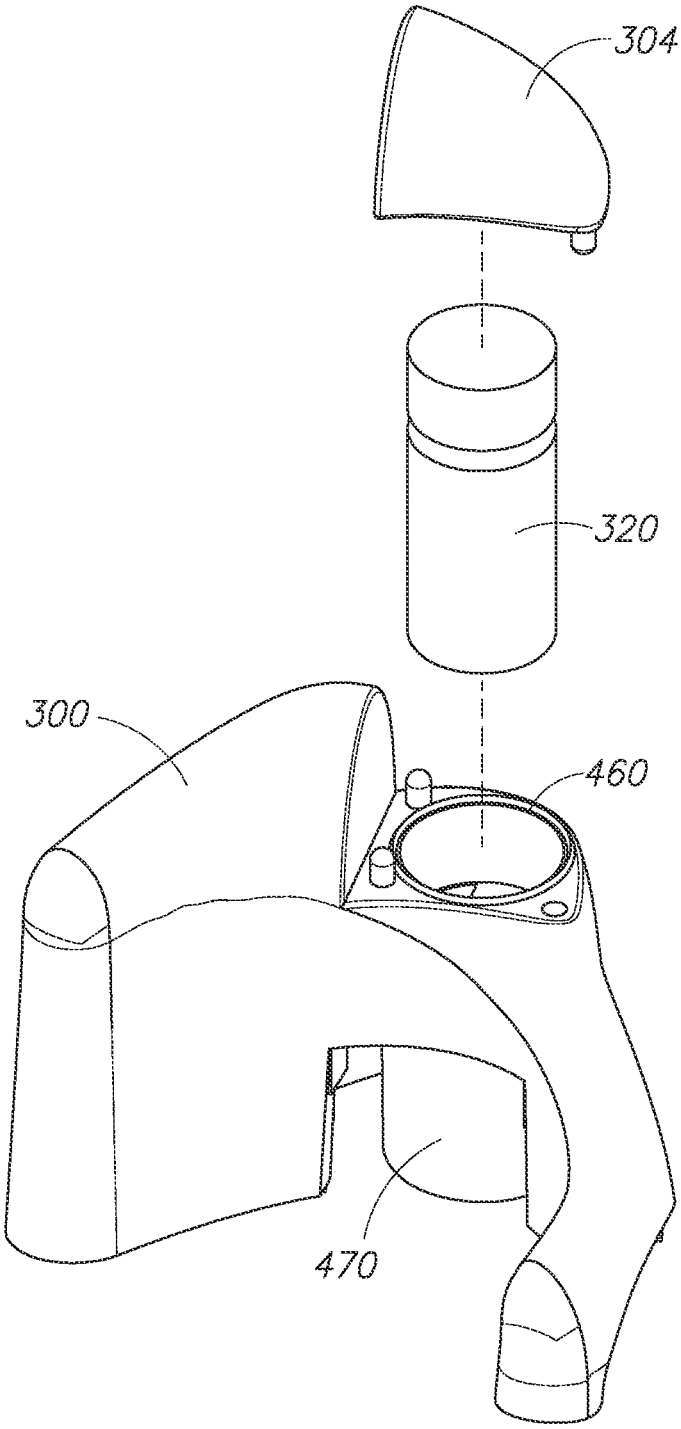
FIG. 16 is a perspective view of an inner housing cover, the motor, and a first inner housing portion of the personal massager of FIG. 1.

Turning to FIG. 16, the first inner housing portion 300 has an opening 460 that is closed by the inner housing cover 304. The motor 320 is received inside the first inner housing portion 300 via the opening 460.

Figure 17:
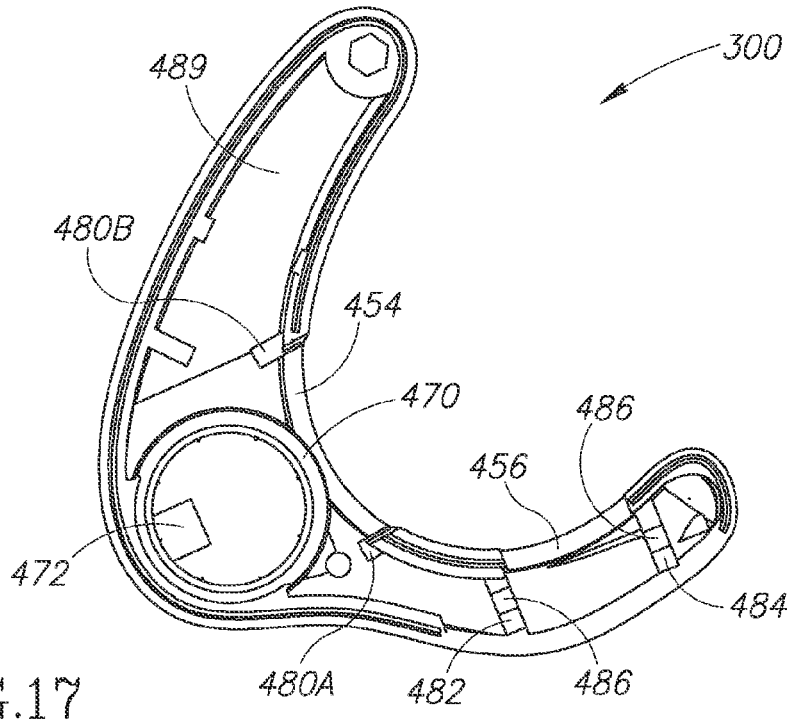
FIG. 17 is a bottom view of the first inner housing portion.

A motor housing 470 extends inwardly into the inner housing 332 (see FIG. 15) from the opening 460. The motor 320 resides inside the motor housing 470 after the motor 320 is inserted into the first inner housing portion 300 through the opening 460. In the embodiment illustrated, the motor housing 470 is substantially cylindrical. However, this is not a requirement. Turning to FIG. 17, the motor housing 470 includes a stop member 472 configured to maintain the motor 320 at a desired position inside the motor housing 470.

A portion of the opening 454 is formed in the first inner housing portion 300. Adjacent the opening 454, the first inner housing portion 300 has inwardly extending spacers 480A and 480B. The tabs 209 (see FIG. 8) of the connector members 208A and 208B bear against the spacers 480A and 480B, respectively, to maintain the curved cover plate 202 (see FIG. 8) inside both the opening 454 of the inner housing 332 and the opening 218 (see FIG. 7) in the outer cover 200.

A portion of the opening 456 is formed in the first inner housing portion 300. The first inner housing portion 300 includes walls 482 and 484 adjacent the opening 456. The walls 482 and 484 each include a recess 486 configured to receive an edge portion of the second substrate 400 (see FIG. 7). The recesses 486 help position the second substrate 400 and maintain the second substrate 400 inside the opening 456.

The first inner housing portion 300 includes a hollow portion 489 configured to receive and house a portion of the battery 312 (see FIG. 7).

Figure 18:
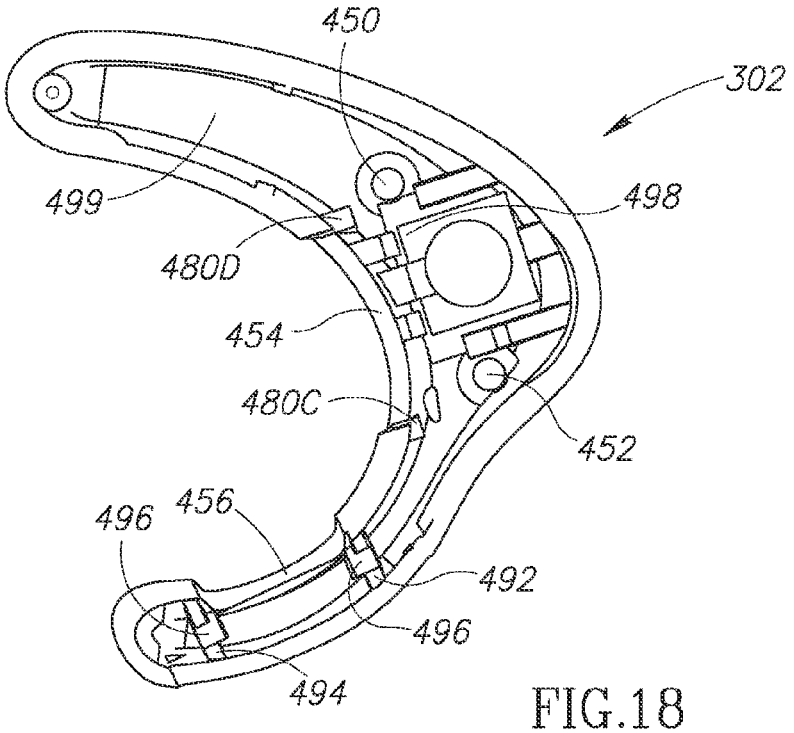
FIG. 18 is a top view of a second inner housing portion.

Turning to FIG. 18, a portion of the opening 454 is formed in the second inner housing portion 302. Adjacent the opening 454, the second inner housing portion 302 has inwardly extending spacers 480C and 480D. The tabs 209 (see FIG. 8) of the connector members 208C and 208D (see FIG. 8) bear against the spacers 480C and 480D, respectively, to maintain the curved cover plate 202 inside both the opening 454 of the inner housing 332 and the opening 218 (see FIG. 7) in the outer cover 200.

A portion of the opening 456 is formed in the second inner housing portion 302. The second inner housing portion 302 includes walls 492 and 494 adjacent the opening 456. The walls 492 and 494 each include a recess 496 configured to receive an edge portion of the second substrate 400 (see FIG. 7). The recesses 496 help position the second substrate 400 and maintain the second substrate 400 inside the opening 456.

The second inner housing portion 302 includes a channel 498 configured to receive and position the first substrate 310 (see FIG. 7). The second inner housing portion 302 includes a hollow portion 499 configured to receive and house a portion of the battery 312 (see FIG. 7).

Figure 19:
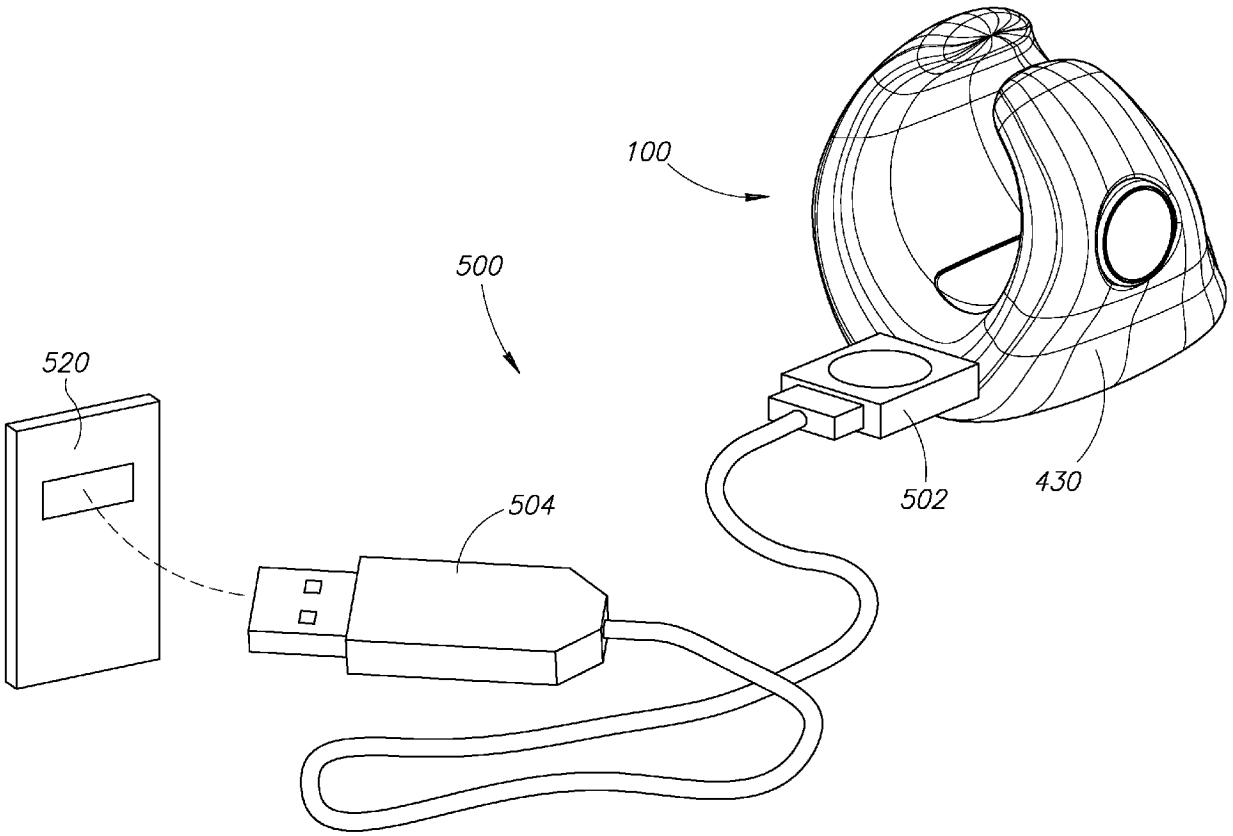
FIG. 19 is a perspective view of a cord configured to recharge the battery of the personal massager of FIG. 1.

Referring to FIG. 19, a cord 500 having a first plug 502 connected to a second plug 504 may be used to recharge the battery 312 (see FIG. 7). The first plug 502 has contacts (not shown) configured to connect to the magnetic contacts 430 and 432 and transfer power thereto. The first plug 502 may include one or more magnets (not shown) configured to adhere magnetically to the magnetic contacts 430 and 432. The second plug 504 is configured to be plugged into a power source 520 (e.g., a Universal Serial Bus ("USB") port). By way of a non-limiting example, the second plug 504 may be a USB plug configured to be received inside a USB jack. However, this is not a requirement.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A personal massager for use with a user, wherein the user has a first finger and a second finger, the first finger being adjacent the second finger, the first finger having a circumference, the massager comprising:

a housing defining an opening configured to receive the first finger, the housing configured to extend partway around the circumference of the first finger when the first finger is received inside the opening, the housing comprising a cylindrically shaped motor housing, an outer surface, a recessed portion, and an outwardly extending portion, the outwardly extending portion having a first curved portion with a first curvature, the motor housing having a second curved portion with a second curvature positioned adjacent to the first curved portion, the second curvature substantially matching the first curvature, the recessed portion being adjacent to the outwardly extending portion, the recessed portion being configured to receive at least a portion of the second finger, the outer surface comprising a massaging portion configured to be placed against a surface to be massaged, the outwardly extending portion being configured to be pressed upon by the second finger when the first finger is received inside the opening and the portion of the second finger is received inside the recessed portion;

a motor positioned inside the motor housing, the motor being operable to vibrate the housing, the motor housing being positioned at least partially within the outwardly extending portion such that the second finger is able to press the motor and the motor housing against the surface to be massaged when the massaging portion is placed against the surface to be massaged and the second finger applies pressure to the outwardly extending portion; and an actuator positioned adjacent the recessed portion on the housing, the recessed portion being positioned between the actuator and the outwardly extending portion, selective actuation of the actuator by the user causing the motor to vibrate the housing.

2. The massager of claim 1, further comprising:

a control circuit connecting the actuator to the motor, the control circuit receiving signals from the actuator and controlling operation of the motor in response to the signals received.

3. The massager of claim 2, wherein the control circuit is configured to cause the motor to vibrate the housing in each of a plurality of vibration patterns, actuating the actuator signals the control circuit of a selection of a selected one of the plurality of vibration patterns, and in response to having been signaled by the actuator of the selection, the control circuit causes the motor to vibrate the housing in the selected vibration pattern.

4. The massager of claim 2, further comprising:

a rechargeable battery coupled to the control circuit and configured to provide power thereto; and a recharging circuit coupled to the battery and configured to supply power thereto.

5. The massager of claim 4, further comprising:

a pair of recharging contacts coupled to the recharging circuit, the recharging contacts being configured to receive power and transfer the received power to the recharging circuit.

6. The massager of claim 5 for use with a power source, further comprising:

a power cord having a first plug configured to supply power to the recharging contacts, and a second plug configured to receive power from the power source and supply that power to the first plug.

7. The massager of claim 6, wherein the second plug is a USB plug.

8. The massager of claim 6, wherein the recharging contacts are magnetic and the first plug includes one or more magnets that are attracted to the magnetic recharging contacts.

9. The massager of claim 1, wherein the actuator is a button, and when the button is depressed continuously for more than a predetermined amount of time as the motor is vibrating the housing, the motor turns off and stops vibrating the housing.

10. The massager of claim 1, wherein the housing is waterproof.

11. The massager of claim 1, wherein the housing further comprises:

an internal housing assembly at least partially surrounded by an outer silicone covering, the internal housing comprising the motor housing, the outer silicone covering comprising the outer surface.

12. The massager of claim 11, wherein massaging projections are formed in a portion of the outer silicone covering.

13. A personal massager comprising:

a motor;

a housing defining a longitudinally extending opening configured to receive a first finger of a user along a longitudinal dimension, the housing having a cylindrically shaped motor housing configured to receive the motor, the motor housing extending along the longitudinal dimension, the housing having an outwardly extending portion that is adjacent to a recessed portion of the housing, the outwardly extending portion having a first curved portion with a first curvature, the motor housing having a second curved portion with a second curvature positioned adjacent to the first curved portion, the second curvature substantially matching the first curvature, the recessed portion being configured to receive at least a portion of a second finger of the user, the outwardly extending portion being configured to be pressed upon by the second finger when the first finger is received longitudinally inside the opening and the portion of the second finger is received longitudinally inside the recessed portion, the housing having a massaging portion configured to be placed against a surface to be massaged, wherein the motor housing is at least partially housed inside the outwardly extending portion such that the second finger is able to press the motor and the motor housing against the surface to be massaged when the massaging portion is placed against the surface to be massaged and the second finger applies pressure to the outwardly extending portion; and an actuator positioned adjacent the recessed portion of the housing, the recessed portion being positioned between the actuator and the outwardly extending portion, selective actuation of the actuator by the user causing the motor to vibrate the housing.

14. The massager of claim 13, further comprising:

a control circuit connecting the actuator to the motor, the control circuit receiving signals from the actuator and controlling operation of the motor in response to the signals received.

15. The massager of claim 14, wherein the control circuit is configured to cause the motor to vibrate the housing in each of a plurality of vibration patterns, actuating the actuator signals the control circuit of a selection of a selected one of the plurality of vibration patterns, and in response to having been signaled by the actuator of the selection, the control circuit causes the motor to vibrate the housing in the selected vibration pattern.

16. A personal massager for use with a user, wherein the user has a first finger, and a second finger, the first finger being adjacent the second finger, the first finger having a circumference, the massager comprising:

a housing defining a longitudinally extending opening configured to receive the first finger along a longitudinal dimension, the housing configured to extend partway around the circumference of the first finger when the first finger is received inside the opening, the housing comprising a cylindrically shaped motor housing, a recessed portion, and an outwardly extending portion, the outwardly extending portion having a first curved portion with a first curvature, the motor housing having a second curved portion with a second curvature positioned adjacent to the first curved portion, the second curvature substantially matching the first curvature, the recessed portion being adjacent to the outwardly extending portion, the recessed portion extending along the longitudinal dimension and being configured to receive at least a portion of the second finger, the outwardly extending portion being configured to be pressed upon by the second finger when the first finger is received longitudinally inside the opening and the portion of the second finger is received longitudinally inside the recessed portion, the housing having a massaging portion configured to be placed against a surface to be massaged, wherein when the massaging portion is placed against the surface to be massaged, pressing on the outwardly extending portion presses the massaging portion against the surface to be massaged;

a motor positioned inside the motor housing, the motor being operable to vibrate the housing, the motor extending into the motor housing along the longitudinal dimension and being positioned at least partially within the outwardly extending portion such that the second finger is able to press the motor and the motor housing against the surface to be massaged when the massaging portion is placed against the surface to be massaged and the second finger applies pressure to the outwardly extending portion; and an actuator positioned adjacent the recessed portion on the housing, the recessed portion being positioned between the actuator and the outwardly extending portion, selective actuation of the actuator by the user causing the motor to vibrate the housing.

17. The massager of claim 16, further comprising:

a control circuit connecting the actuator to the motor, the control circuit receiving signals from the actuator and controlling operation of the motor in response to the signals received.

18. The massager of claim 17, wherein the control circuit is configured to cause the motor to vibrate the housing in each of a plurality of vibration patterns, actuating the actuator signals the control circuit of a selection of a selected one of the plurality of vibration patterns, and in response to having been signaled by the actuator of the selection, the control circuit causes the motor to vibrate the housing in the selected vibration pattern.

* * * * *